US007009497B2

(12) United States Patent
Nicoletti et al.

(10) Patent No.: US 7,009,497 B2
(45) Date of Patent: Mar. 7, 2006

(54) METHOD OF DISTINGUISHING THE PRESENCE OF A SINGLE VERSUS MULTIPLE PERSONS

(75) Inventors: Ryan Nicoletti, Indianapolis, IN (US); Tim Bruemmer, Carmel, IN (US); Rich McGillicuddy, Carmel, IN (US)

(73) Assignee: HDS Acquisition Company, Caramel, IN (US)

( * ) Notice: Subject to any disclaimer, the term of this patent is extended or adjusted under 35 U.S.C. 154(b) by 130 days.

(21) Appl. No.: 10/394,922

(22) Filed: Mar. 21, 2003

(65) Prior Publication Data

US 2004/0183667 A1 Sep. 23, 2004

(51) Int. Cl.
*G08B 11/00* (2006.01)

(52) U.S. Cl. ..... 340/286.05; 340/573.1; 340/587; 340/578

(58) Field of Classification Search ..... 340/286.05, 340/573.1, 541, 545.3, 565, 628, 629, 587, 340/578

See application file for complete search history.

(56) References Cited

U.S. PATENT DOCUMENTS 4,665,390 A * 5/1987 Kern et al. ..... 340/587
5,475,364 A * 12/1995 Kenet ..... 340/522
5,940,799 A 8/1999 Bruckert et al.
5,960,085 A 9/1999 de la Huerga
5,978,769 A * 11/1999 Brown et al. ..... 705/4
5,991,429 A 11/1999 Coffin et al.
6,111,517 A 8/2000 Atick et al.
6,114,948 A * 9/2000 Astell ..... 340/332
6,144,948 A * 11/2000 Walker et al. ..... 705/38
6,307,475 B1 * 10/2001 Kelley ..... 340/573.1
6,474,683 B1 11/2002 Breed et al.
6,480,101 B1 11/2002 Kelly et al.
6,712,269 B1 * 3/2004 Watkins ..... 235/385
6,762,686 B1 * 7/2004 Tabe ..... 340/573.1
6,771,173 B1 * 8/2004 Clayton et al. ..... 340/573.1

OTHER PUBLICATIONS

Samuels, M. and Witmer, 3., *Statistics for the Life Sciences*. 2nd ed. Prentice-Hall, Inc., 1999. Upper Saddle River, NJ, Section 10.1—Inference for Proportins: the Chi-Square Goodness-of-Fit Test, pp. 383-392.

* cited by examiner

*Primary Examiner*—Daryl C Pope
(74) *Attorney, Agent, or Firm*—Ice Miller

(57) ABSTRACT

A plurality of sensors are positioned in a home. Sensor fire data is delivered to a remote server, and the sensor fire data is segmented into single-state blocks broken up by door opening and closing events. The door opening and closing events represent potential state changes in the home where the number of people present in the home may have changed. The raw data from the sensor fires are then processed into adjacent sensor fires and used to populate adjacency matrices and frequency distributions. That information is subjected to a statistical goodness-of-fit test, which reveals a probability indicating the likelihood a given data block should be attributed with the single or multiple person state. The single versus multiple person state is passed along with these data to the remainder of the data analyses, which can then be properly aware of which data should be treated with due suspicion.

30 Claims, 2 Drawing Sheets

METHOD OF DISTINGUISHING THE PRESENCE OF A SINGLE VERSUS MULTIPLE PERSONS

BACKGROUND

The invention relates to the field of monitoring, particularly passive monitoring, of an individual living in a residence.

Automated systems for data collection and event monitoring have been developed for myriad applications where inconvenience, cost-prohibition, or other considerations prevent experts and personnel from constantly being on-hand themselves to perform these services. Example systems include networks of electricity meters which automatically report homeowners' power consumption to the utility company periodically, security sensor arrays which detect intruders by monitoring an area for unexpected activity, speed monitoring mechanisms in motor vehicles for assessing drivers' observance of speeding regulations, and medical telemetry for implanted devices monitoring blood pressure, heart pacing, and other cardiac function indicators.

Recent research and development efforts have sought to apply the knowledge in this field to monitoring home activity and lifestyle trends particularly focused on aiding the elderly. Potential applications of this information include medical research studies, patient diagnoses, emergency response systems, interactive assisted living, and home automation. However, several obstacles relating to inherent difficulties in collecting and understanding the necessary data from such a home monitoring system stand in the way of the advancement of these applications. Technological advances in these data analysis dilemmas are the key to enabling this application.

One of the most important keys to enabling such a home monitoring system is being able to ascribe each piece of data collected to the individual responsible for the observed activity corresponding to that datum. The potential utility of the behavioral and performance tendencies uncovered by the data analysis mechanisms used will be drastically reduced if those mechanisms are unable to distinguish with a high level of confidence which observations belong to which individual being observed. Visual recognition systems could potentially be employed to make this determination, but subjects have balked at the suggestion that cameras could be included in the sensor array due a fear of the opportunities for clandestine surveillance which this might present. Subjects could be required to wear, carry, have implanted (the human corollary to the chips which identify embedded computers in these systems), or otherwise bear a tag such as an IR or RF transmitter which would distinguish them from each other and other individuals which may come into the sensor array's field of observation. However, not only is this solution considered a nuisance to the individuals required to bear the tag, but it would necessitate incorporating the appropriate receiver into each sensor as well.

A preferable solution would provide a passive system for monitoring the subjects, thereby avoiding those systems that require subjects to wear transmitters and tags or take other active compliance steps. Such a passive monitoring system would free the subject of the constant requirement of wearing a transmitter or similar device. Furthermore, such a passive monitoring system could preferably be implemented using simple sensors such as motion sensors and contact switches for doors and windows. These sensors are less expensive than more sensitive and/or intelligent sensors and would save on the overall cost of a home monitoring system.

Furthermore, consumers do not find such sensors overly invasive and have already set a precedent for allowing motion sensors and contact switches in their homes in the context of home security systems. Of course, as mentioned above, the home monitoring of a particular subject requires the ability to distinguish between the subject being monitored and others present in the home. This ability would also be required in a passive monitoring system. However, passive monitoring devices have generally been unable to ascribe each piece of data collected to the particular individual responsible for the observed activity, and this has been a significant obstacle to the development of passive monitoring systems that may be used to monitor a particular individual in his or her home.

The observation has been made that elderly adults living alone are part of a group of people especially in need of monitoring because of the increasing health concerns that are associated with age and the isolation that is associated with living alone. For example, if an elderly adult living alone has an accident or other health emergency, such as a fall, the injuries may be such that he or she is unable to reach a telephone and contact an emergency provider. Furthermore, an elderly adult living alone may not even recognize changes in daily behavior that are indicative of a serious health problem. Accordingly, such persons are in particular need of in-home monitoring. On the other hand, there is not as much of a need to passively monitor an elderly person who lives with another capable adult, because the other capable adult serves to monitor the elderly person. In particular, the other adult can recognize changes in behavior and will see any accidents that require the assistance of emergency providers and/or physicians. Accordingly, the other adult can contact the appropriate parties for assistance. Therefore, even with an elderly person that is living alone, there is not as much need to monitor the person when other parties are present in the home. What is needed is the ability to passively monitor a subject during the times that he or she is alone in the home.

SUMMARY

Recognizing that passive monitoring is generally more desirable to monitored subjects and that an important time to monitor a subject is during the time that he or she is alone provides insight into a method of providing a passive monitoring system. In particular, a method of distinguishing between the presence of a single person versus multiple persons in a home would provide an important tool for use in passive monitoring systems. Specifically, the ability to distinguish between the presence of a single and multiple persons in a home would allow a passive monitoring system to track and analyze the status of the subject being monitored during those times when only a single person is determined to be present in a home. During times when it is determined that multiple people are present in a home, the passive monitoring system would not attempt to monitor the activities of the subject.

A method of distinguishing the presence of a single versus multiple persons is accomplished by first collecting data from a plurality of sensors positioned throughout a residence. The sensors monitor activities within the home, including detection of activity in individual rooms of the home and opening and closing of entrances to the home. The data from the sensors is delivered to a receiver that passes a data stream on to a remote server.

Once the data is received by the server, it is split into blocks of time during which the home is continuously in a single state of having one person, more than one person, or no persons in the home. These blocks are tested for activities observed which can only be reasonably explained under the conclusion that more than one person was present in the house during that time. Note the heuristic that the presence of a single individual in the single-person home is very likely to be indicative of the presence of the individual that lives there. Under this assumption, demarking blocks of time when a single versus multiple persons were present in the home allows the separation of times when the activity can be confidently ascribed to the individual being monitored and when it cannot. Further data analyses can then weight these different time periods according to their sensitivity to foreign activity in the data.

Once the data has been separated into blocks which represent a single state of the home, the data must be classified in a way that highlights some measurable differences in the characteristics of blocks of data generated by the activities of a single person versus blocks of data generated by the activities of multiple people in the home. Motion sensors are installed in each room of the home, and the raw data is processed into adjacent sensor fires, i.e., a fire from one sensor immediately followed by a fire from a different sensor, indicating a transition from one room to another. Two important differences between data in different states may be observed once the data is represented in this form, each characterized by a particular type of adjacent sensor fire which only occurs when multiple people are present in the home. Due to the geometry of the home, it will be impossible for a single person to be able to stimulate sensors in non-adjoining rooms without crossing the intermediate room first. However, if multiple people are in the home and one person is in each of these rooms, this activity can produce these adjacent sensor fires which are impossible (barring imperfections in the data from messages missed due to communication interference) when only one person is home. Multiple people in the home also produce data unlikely to be associated with a single person in the home when one person is in each of two adjoining rooms. The adjacent sensor fires produced in this case imply the improbable situation where a single person crossed back and forth between these rooms repeatedly.

A probability distribution of these adjacent sensor fires is constructed from the data to describe the normal activity of the single subject in his or her home. Then, for each of the given single-state data blocks, a statistical goodness-of-fit test is performed to compare the probability distribution of adjacent sensor fires in the data block to the control distribution for the single subject's normal activity. If the test states within a certain degree of confidence that these distributions match, the data block tested is demarked as belonging to the single person state of the home and can be confidently subjected to all further analyses. If the test cannot draw this conclusion, the data block is demarked as potentially belonging to the multiple person state of the home and is treated with the appropriate caution when further analyses make inferences based on this data.

DESCRIPTION

Figure 1:
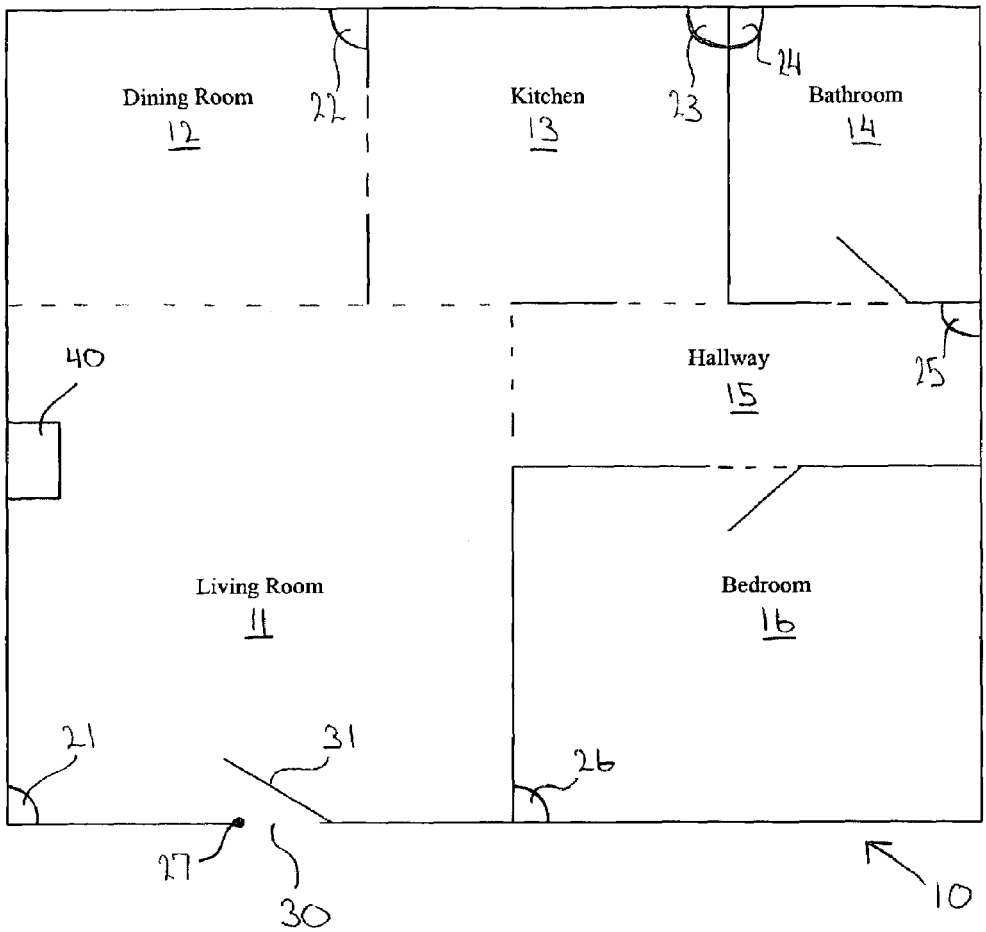
FIG. 1 shows a plan view of a residence having a plurality of sensors used to determine the presence of a single versus multiple persons in the residence.

With reference to FIG. 1, a passive home monitoring system includes a plurality of sensors 21–27, installed within a home 10, apartment or other residence where a single individual resides. The home 10 includes a plurality of living spaces or areas 11–16 where a human may be found. Some of the areas are contiguous and other areas are not contiguous. For example, in FIG. 1, living room 11 and dining room 12 are contiguous because no other living areas need to be entered when moving between the two areas. However, kitchen 13 and bathroom 14 are not contiguous because hallway 15 must be entered when moving between kitchen 13 and bathroom 14. Contiguous rooms are also referred to herein as "adjoining" rooms.

The sensors 21–27 may be any of a wide array of sensors operable to collect data from the home, including motion sensors, gait speed sensors, and contact switches for doors, windows, and cabinets, or any other sensors that may be used to collect desired data from the home., In many situations, motion sensors and contact switches which have already been installed in homes as components of security systems are used as part of the home monitoring system. Each of the sensors 21–27 is operable to fire upon the occurrence of some event and/or detection of some status. For example, in FIG. 1, each of the sensors 21–26 positioned within one of the living spaces 11–16 is associated with that living space and operable to fire when a human or other life form moves within that living space. Sensors 21–26 are shown in FIG. 1 as positioned in the corners of the rooms, and could be typical infrared sensors as are commonly used in home security systems. The dotted lines of FIG. 1 are represent perimeter portions of the defined areas that may be crossed when moving between rooms. These dotted lines are also provided to show definition between different rooms within the home and represent the extent that any one sensor 21–26 may detect activity within a particular room. Sensor 27 is associated with a door 31 that provides an entrance/exit 30 to the residence. Opening or closing of door 31 will cause sensor 27 to fire.

Information from each sensor 21–27 is relayed to a receiver 40 positioned in the home 10 upon the occurrence of the sensor firing. The information relayed to the receiver 40 includes data related to the occurrence of a sensor fire and time and date of sensor fires. The information from the sensors 21–27 is relayed to the receiver by rf transmission. Of course, any number of other acceptable means, including wire transmission, power line transmission, or optical transmission may be used to transmit information from the sensors to the receiver 40.

The receiver 40 is connected to a communication interface, such as a telephone or cable modem, and is operable to send the collected data to a remote server (not shown) using telephone lines, the internet, rf transmission, dedicated data transmission lines, or any other acceptable medium of data transfer. The receiver 40 sends a data stream (or "data set") to the remote server on a periodic basis, such as once every six hours. Alternatively, the receiver may be designed to deliver information upon the occurrence of some event, such as every fifth sensor fire or the firing of sensor 27.

The remote server includes a processor operable to analyze data. The server receives the data stream from the sensors 21–27 and processes the information to remotely monitor the activities of an individual subject within the home using the received data. By monitoring the activities of the subject, the remote server can determine if an alert condition exists. An alert condition is a condition in which the individual appears to have departed from a normal course of activities. Accordingly, an alert condition may indicate that an emergency situation exists where emergency responders should be provided to the residence. The existence of an alert condition will typically result in some action being taken to check on the status of the individual in the residence. For example, the existence of an alert condition may result in a designated care provider, such as a family member, being contacted and informed that such an alert condition exists. The designated care provider may then investigate whether the individual requires further assistance by visiting the residence, placing a telephone call, or taking other action.

Before the server can determine whether an alert condition exists, the server must first determine what pieces of received data are relevant and appropriate for further analysis. As discussed previously, it is assumed that when multiple persons are present in the home that the subject is sufficiently monitored by those persons, and the system does not attempt to monitor the subject when multiple persons are present. Furthermore, when no one is present in the home, there is no need to monitor the subject. However, when the subject is the only individual present in the home, the monitoring system is used to analyze the data and determine if an alert condition exists. Therefore, before a determination can be made as to whether an alert condition exists, the received data must be categorized as being associated with one of three possible home states. Accordingly, the three data categories include (i) data representative of a single person in the residence, (ii) data representative of multiple persons in the residence, or (iii) data representative of no persons in the residence. Of these three categories, data fitting into the category representative of no persons in the residence is not further analyzed and is dismissed as uninteresting. Data fitting in the category representative of multiple persons in the residence is not further analyzed, as this data can not be reliably associated with the actions of the test subject. However, data representative of a single person in the residence is of particular interest, and is further analyzed to determine if an alert condition exists. Of course, when the data analysis-indicates a single person is present in the home, the subject to be monitored—who lives in the home—is assumed to be the person present in the home.

Figure 2:
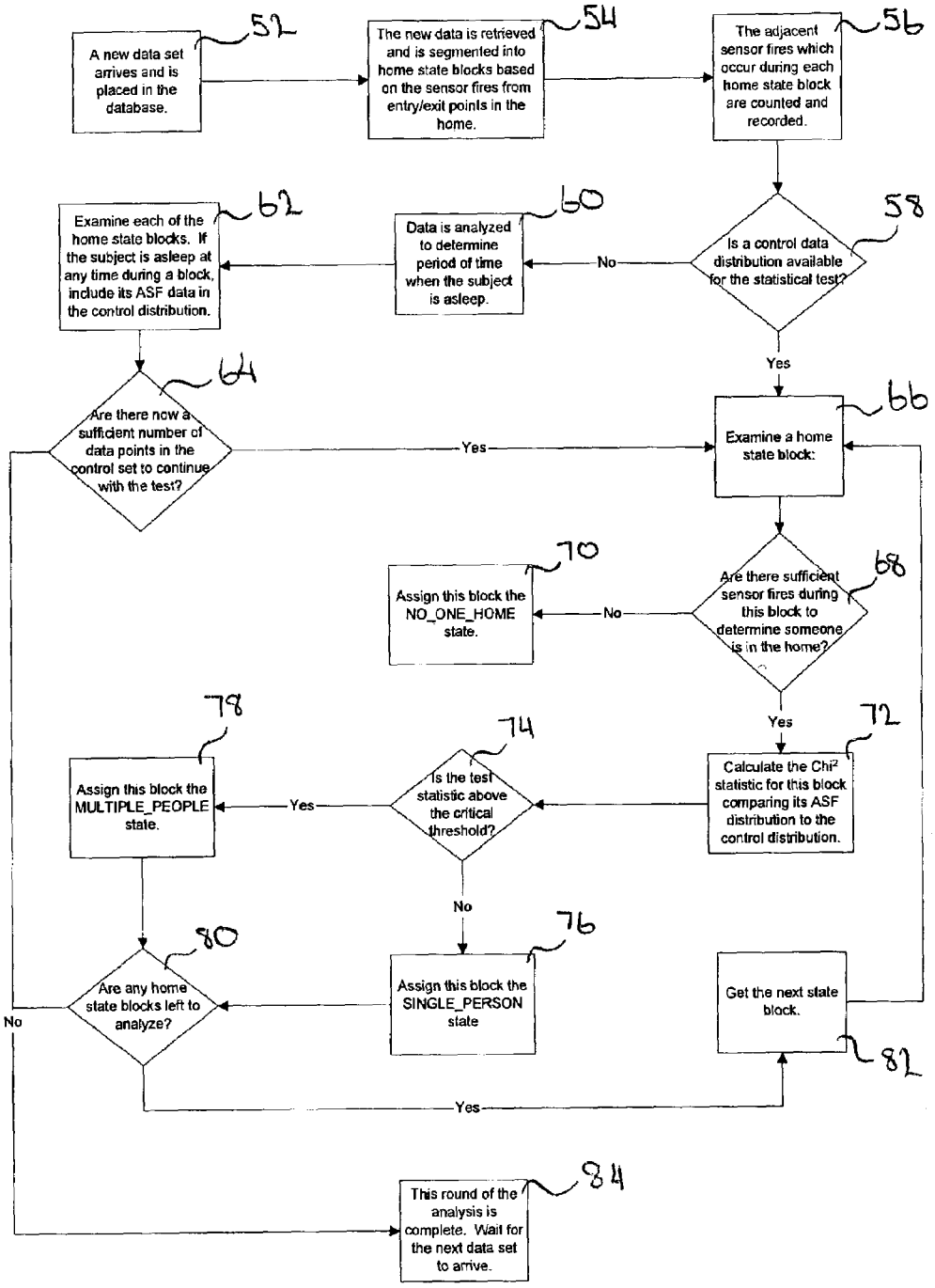
FIG. 2 shows a flowchart of a method for determining the presence of single versus multiple persons in a residence.

FIG. 2 is a flow-chart showing a method for determining whether single or multiple persons are present in the home. As indicated in step 52, the server first receives a new data set and the data set is stored in a database associated with the server. As mentioned previously, different conditions will exist for different groups of data within the new data set. For example, one group of data may be from a time that a single person is home, and another group of data may be from a time when no one is home. Therefore, as noted in step 54, upon receiving a data set from the receiver 40, the remote server splits the data into contiguous home state data blocks (or simply "data blocks" or "home state blocks") that are likely to be representative of different categories or states of the home. In other words, the remote server splits the received data into contiguous data blocks that represent time periods in which the home was continuously in a single state.

When splitting data into contiguous data blocks, one significant consideration is that the state of the home may only change in the event that an individual enters or exits the home. Such a change of state is assumed to only occur through one of the home's outer doors, upon each of which a contact switch sensor is installed. In FIG. 1, only one door 31 exists, and contact switch 27 is associated with that door. Each time the door opens or closes, the contact switch 27 fires, and the sensor fire is recorded with a timestamp. This sensor fire represents a door entry and/or exit event, also referred to herein as a "door open/close event" or simply a "door opening event". Receipt of this information representing a door open/close event alerts the remote server that this sensor fire is associated with a potential state change within the home. Therefore, as noted in step 54 of FIG. 2, each stream of sensor data received from the remote server is first analyzed by being broken up into data blocks separated by these door open/close events.

Once the sensor fire data stream is segmented into blocks, each block must be subjected to an analysis of its data to decide whether that data was generated due to the activities of a single or multiple individuals in the home. In order to accomplish this, the data must be represented in a way that highlights a measurable difference between blocks of sensor fires arising from a single individual's activities and blocks arising from multiple persons' activities. In one embodiment, "adjacent sensor fires" are analyzed to determine whether a data block is representative of the presence of a single or multiple persons. Adjacent sensor fires (also referred to herein as "ASFs") are any two consecutive sensor fires in a data block that are from different sensors. For example, when an individual leaves a room in a monitored house, a motion sensor in the room fires due to the stimulation caused by his or her movement. This is closely followed by a second fire from a different motion sensor located in the room the individual moves to. The pattern of two consecutive fires from different sensors is an "adjacent sensor fire." On the contrary, when an individual remains in a given room of the home for some time, multiple consecutive sensor fires will occur from the same sensor. Multiple consecutive sensor fires from the same sensor are not "adjacent sensor fires" as used herein.

Two particular types of adjacent sensor fire patterns will occur much more frequently in data blocks generated by multiple persons' activities than in data blocks generated by a single person's activities. The first type of adjacent sensor fire that occurs more frequently when multiple persons are present in the home is the non-contiguous adjacent sensor fire, i.e., adjacent sensor fires associated with non-contiguous rooms. The second type of adjacent sensor fires that occur more frequently when multiple persons are present are increased frequency adjacent sensor fires, i.e., a large number of adjacent sensor fires occurring over a relatively short period of time. To understand this phenomenon, first consider the firing patterns expected for a single subject moving about the home shown in FIG. 1. When the subject remains in a single room, such as the living room 11, the sensor 21 associated with that room will fire continuously to corresponding activity in that room while no other sensors fire. Once the subject moves between rooms, such as from the living room 11 to the kitchen 13, the sensor 21 in the living room fires one final time, and that fire is followed by the first fire of the sensor 23 as the subject arrives in the kitchen 13. Thus, as the subject moves about the entire home, adjacent sensor fires are recorded for each of these transitions between adjoining rooms. However, no adjacent sensor fires will be recorded for transitions between non-adjoining rooms, as the subject is required to traverse the intermediate room (or rooms) joining any non-adjoining rooms, which will stimulate the motion sensor associated with the intermediate room as well. For example, if the subject moves from the kitchen 13 to the bathroom 14, he or she must first enter the hallway 15. In, this situation, two adjacent sensor fires will be recorded, including adjacent sensor fire 23-25 and adjacent sensor fire 25-24.

The differences in the patterns of adjacent sensor fires in multiple persons' activities versus a single person's activities are due to the ability of multiple persons to occupy multiple rooms in the home concurrently. A quick example makes this conclusion apparent—consider two children doing jumping jacks in two separate rooms of a monitored house. Each of these children will continually stimulate the sensor in his or her room, and the fired messages will stream together and interlace at the receiver. When this occurs with individuals occupying non-adjoining (i.e., non-contiguous) rooms, this phenomenon manifests itself as a string of adjacent sensor fires from non-adjoining rooms. If only a single person had generated such sensor fires, it would suggest the single individual had managed to pass back and forth between the two non-adjoining rooms several times without stimulating the intermediate-sensor. While an error in the data transmission might cause the loss of a message which could legitimately allow this "impossible" adjacent sensor fire to occur very infrequently, the probability that such errors would repeatedly occur is minimal. Therefore, finding this characteristic of multiple adjacent sensor fires from non-contiguous rooms in a particular data block is indicative of the presence of multiple people in the home during that time.

Likewise, if the above scenario occurs with individuals occupying adjoining rooms, the phenomenon instead manifests itself as a large string of adjacent sensor fires from adjoining rooms over a short period of time. If a single person had caused such sensor fires, this would suggest the single individual had repeatedly passed back and forth between two adjoining rooms, apparently without stopping for any significant period of time in either room. The probability of this scenario is also minimal. Thus, finding this characteristic of a large number of adjacent sensor fires between contiguous rooms over a short period of time in a data block is also indicative of the presence of multiple people in the home.

Returning to FIG. 2, step 56 shows that after the data stream is separated into home state blocks, adjacent sensor fires are counted and recorded for each home state block. The adjacent sensor fires are counted and recorded for use in a statistical test that is performed upon the adjacent sensor fires to determine if the adjacent sensor fires indicate the presence of single or multiple persons. An example of such a test is provided in the example below. The statistical test anticipated in the disclosed embodiment of the invention requires a control data distribution against which the adjacent sensor fires may be compared. The control data distribution is a model of the expected adjacent sensor fires and frequency of such adjacent sensor fires that will hypothetically occur in a particular home with a single person present. Before such a control data distribution can be compiled, the system must first collect a minimum amount of data about the home with a single person present. Thus, decision step 58 of FIG. 2 determines whether a control data distribution is even available for analyzing a particular home state data block. If a control data distribution is not available, the instructions of step 60 are followed. If a control data distribution is available, the instructions of step 66 are followed.

If a control data distribution is not available, the system must determine what data may be used to build the control data distribution. In general, the desired data for the control data distribution is the data recorded when a single person is home. The system anticipates that, because the subject lives alone, no other persons will be present in the home when the subject is sleeping in the bedroom. Therefore, an analysis is performed in step 60 of FIG. 2 to determine the period of time when the subject is asleep. The analysis to determine the period of time when the subject is sleeping may be complex or simple. For example, one simple analysis would be to conclude that repeated sensor fires from the bedroom over a period of time when the subject is expected to be asleep (e.g., 12 pm to 5 am) indicates that the subject is sleeping. Then, in step 62 of FIG. 2, if the subject is determined to be sleeping at any time during a home state data block, it is assumed that the subject is alone for that entire home state data block, and the adjacent sensor fires from the entire home state data block are used to build the control data distribution. Thereafter, in step 64, the system again determines if the control data distribution includes a sufficient number of data points to continue with the statistical test. If the answer is no, the analysis is complete for that data block, and the system processes the next data block or waits for the next data set to arrive, as noted by step 84 of FIG. 2. However, if the control data distribution does have a sufficient number of data points, the data block is examined, as noted in step 66 of FIG. 2.

Starting with step 66 of FIG. 2, a data block is examined. First, as shown in step 68, it must be determined if the data block has enough sensor fires to determine if someone was present in the home during the period of time the data block represents. For example, if at least 10 sensor fires are required to make a meaningful analysis, a data block with less than 10 sensor fires will be discarded as unimportant and the state of the home will be considered empty during that time, as noted in step 70 of FIG. 2. Such situations may occur when a subject quickly enters a home for some reason, such as to retrieve a set of keys, and then quickly exits the home. However, if a sufficient number of sensor fires are available for a meaningful analysis, the statistical analysis of the data block will be performed, comparing the adjacent sensor fires of the data block against the control data distribution, as noted in step 72. A goodness-of-fit test is one type of statistical test that may be used to perform such an analysis. Furthermore, the "chi-squared test" (i.e., the $\chi^2$ test) is a well-known test that may be used to perform the analysis. This test is used in the example provided below.

The $\chi^2$ test is a statistical test for comparing the observed frequency of each adjacent sensor fire from a data block to the expected frequency of that adjacent sensor fire from the control data distribution. The result of the $\chi^2$ test is a test statistic that may be used to determine the probability that the analyzed data block is representative of a single person being present in the home. As indicated in step 74, the resulting test statistic is then compared to a predetermined critical threshold that determines the probability that a single person is present in the home. As shown in step 78, if the test statistic exceeds a predetermined critical threshold such that the probability that only a single person is present is below an acceptable level (e.g., below 5% probability that a single person is present), the data block is considered to be representative of the multiple person state. Conversely, as shown in step 76, if the test statistic is below a predetermined critical threshold such that the probability that only a single person is present reaches an acceptable level (e.g., above 5% probability that a single person is present), the data block is considered to be representative of the single person state. Of course, different predetermined critical threshold levels (and related probabilities) may be used, depending upon the desired specifications of the system. After making a determination whether a single person or multiple persons are associated with a particular data block (based on the test statistic and resulting probabilities), the system determines if any data blocks remain to be analyzed, as shown in step 80 of FIG. 2. If any such data blocks remain, the system gets the next data block in step 82, and repeats the above analysis for the next data block. If no additional data blocks are available for analysis, the system determines that the analysis is complete and waits for the next data set to arrive, as indicated in step 84.

When a data block is identified as being associated with the "no one home" state or the "multiple person" state, that data block is discarded and no further analysis is performed on that data block. However, if a particular data block is identified as being associated with the "single person" state, the sensor fires in that data block may then be subjected to further analyses which monitor the subject's state of health. In particular, as described above, the sensor fires for the data block are analyzed to determine if an alarm condition exists in the home. Analysis of the sensor fires from the data block may be conducted in a number of different ways. For instance, in a more simple method of analysis, sensor fires from a block which had a 90% chance of being drawn from the control population (i.e., single person present control population) would have the same influence on analysis results as sensor fires from a block which had just a 45% chance of being drawn from the control population, because both of these blocks would be ascribed to the single person state. However, a revision to this method might make better use of the probability calculated as a result of the statistical test as a measure of confidence which indicates not only which data should be included in these further analyses, but how heavily it should be weighted. For example, in an alternative method, sensor fires from the block which had a 90% chance of being drawn from the control population (i.e., single person present control population) would be weighted to have twice the influence on analysis results as sensor fires from the block which had just a 45% chance of being drawn from the control population.

These further analyses are performed in an attempt to determine the status of the test subject, and whether an alert condition exists. For example, in the situation described above, sensor fires that might be indicative of an alert condition in the 45% block may not carry enough weight by themselves to result in an alert condition. A larger number of suspicious sensor fires from the 45% block, or a combination of suspicious sensor fires from other blocks, would be required before the system had enough information to suggest an alert condition. On the other hand, because the sensor fires in the 90% block carry twice the weight as the 45% block, these same sensor fires from the 90% block might be sufficient by themselves to result in an alert condition. Accordingly, one embodiment of the invention anticipates weighting sensor fire data when determining whether an alert condition exists, and the weight of the sensor fire data is based on the calculated probability that a single person is present in the residence.

As discussed previously, alert conditions generally arise in association with a suspicious series of sensor fires. For example, if the further analysis of the sensor fires in a given data block shows that a subject has made an unusually large number of trips to the bathroom over a particular period of time, an alert condition may be signaled by the system. Likewise, if the person has remained sedentary for an unacceptable period of time, an alert condition may be signaled. When an alert condition is signaled by the system, action is taken to determine the well-being of the subject. Typically, the designated care provider will be contacted and informed of the alert condition so the designated care provider can contact the subject and investigate his or her condition.

EXAMPLE ANALYSIS

An example analysis of the method of determining the existence of single versus multiple persons is now provided. As discussed previously, FIG. 1 is a diagram of a simple residence and its corresponding sensors. Suppose a single person who occupies the home comes home from the grocery store. She walks in the entrance 30 to her living room 11 and takes off her coat before carrying her bag of groceries to the kitchen 13. She puts the milk in the refrigerator to keep it cold before going to the bathroom 14; she then returns to the kitchen 13 to finish putting up her groceries. She cooks some soup for dinner on the stove and sets the table for herself in the dining room 12 while she waits for it to heat up. She then retrieves the soup from the kitchen 13 and brings it to the table in the dining room 12 to sit down to dinner. This particular pattern of activity could generate the following sensor fires:

21-21-21-21-21 (The woman enters and takes off her coat)
23-23 (She leaves her groceries in the kitchen)
25 (She enters the hallway)
24-24-24-24-24-24 (She goes to the bathroom)
25-25 (She enters the hallway)
23-23-23-23-23-23-23-23-23-23-23-23 (She returns to the kitchen)
22-22-22-22-22 (She goes to the dining room to set the table)
23-23-23-23 (She returns to the kitchen to retrieve her soup)
22-22-22-22-22-22 (She sits down at the dining room table to eat)

Thus, the data stream for this pattern of activity looks like this:

21-21-21-21-21-23-23-25-24-24-24-24-24-24-23-23-23-23-23-23-23-23-23-23-23-23-23-23-22-22-22-22-22-23-23-23-23-22-22-22-22-22-22

Now suppose the next time the woman shops for groceries, she returns with her son, who plans to stay the night for dinner. They both come in and take off their coats, then the woman follows her son into the kitchen, and her son offers to put up her groceries while she goes to the bathroom. She returns to the kitchen and her son sits on the counter and watches while she fixes the soup, until she suggests he set the table while she finishes cooking. After the soup is done, she carries it to the table where the two then sit down to enjoy their meal together.

This particular pattern of activity could generate the following sensor fires:

21-21-21-21-21 (The woman and her son enter and take off their coats)
23-23 (He starts unloading groceries)
25 (She enters the hallway)
24 (She enters the bathroom)
23-24-23-23-24-24 (While she is in the bathroom, he unloads groceries)
25 (She comes back toward the kitchen through the hallway)
23-23-23-23-23-23-23-23-23-23-23 (She starts dinner)
23-22-22-23-22-23-23-22-23 (He sets the table and she finishes the soup)
22-22-22-22-22-22 (The woman and her son eat the meal in the dining room)

Thus, the data stream for this pattern of activity looks like this:

21-21-21-21-21-23-23-25-24-23-24-23-23-24-24-25-23-23-23-23-23-23-23-23-23-23-23-22-23-22-22-23-22-23-23-22-22-22-22-22-22-22

Examining transitions between one sensor firing to another firing, note the adjacent sensor fires in the single person example are:

21-23, 23-25, 25-24, 24-25, 25-23, 23-22, 22-23, 23-22

The same examination of the multiple person example yields these adjacent sensor fires:

21-23, 23-25, 25-24, 24-23, 23-24, 24-23, 23-24, 24-25, 25-23, 23-22, 22-23, 23-22, 22-23, 23-22

This scenario provides an example of each of the characteristic differences between the adjacent sensor fires for different home states. First, note that in this home's layout, the subject cannot reach the bathroom 14 without entering the hallway 15. Thus, the only possible adjacent sensor fires that are possible for one person to generate involving the bathroom are 25-24 and 24-25. Any other adjacent sensor fire involving the bathroom 14 must be a fluke and will occupy only a very small amount of the distribution of the entire population of sensor fires for one person living in that home. Thus, seeing one-quarter of the adjacent sensor fires of either 23-24 or 24-23 in the second pattern of activity is highly likely to be indicative of the presence of multiple people in the home. One person needed to occupy the kitchen 13 and another person needed to occupy the bathroom 14 at the same time to produce that many of those adjacent sensor fires. Depending upon the size of the data block, while a few adjacent sensor fires from non-contiguous rooms could be dismissed as an insignificant error, a statistically significant number of adjacent sensor fires from non-contiguous rooms is indicative of the presence of multiple persons in the home.

Second, note that in the first example, only three adjacent sensor fires occur from the kitchen 13 to the dining room 12 (i.e., adjacent sensor fires 22-23 or 23-22), while in the second example, many more occur. Once again, this is highly likely to be indicative of the presence of multiple people. For only one person to have generated this data, he or she would have to have moved back and forth from the kitchen to the dining room many times over the short period of time in which the data was gathered. One person occupying each of these connected rooms at the same time is a much more probable explanation. Again, a statistically significant number of adjacent sensor fires between two contiguous rooms over a short period of time is indicative of the presence of multiple persons in the home.

As indicated above, adjacent sensor fires are useful in determining whether single or multiple persons are present in a home. What is required next is a test for determining whether the adjacent sensor fires in a given data block are indicative of the presence of a single person or a multiple person. One method of determining this begins with reducing a data block to adjacent sensor fires and recording those adjacent sensor fires in an adjacency matrix. By assuming a subject who lives alone will spend most of his or her time at home by his or herself, this adjacency matrix is chosen as representative of a single person's activities in the home. Noting zero or "very small" entries (to account for potential errors in the data) in the matrix versus non-zero and "appropriately large" entries allows inferences to be drawn denoting which rooms within the house are adjoining and which are not. A mathematical graph of nodes representing the rooms of the home and edges representing which rooms adjoin may then be created to display the home geometry. The entries of the matrix are then normalized to represent the frequency of occurrence of each particular adjacent sensor fire relative to the total number of adjacent sensor fires by dividing each entry by that total.

Next, to test for single versus multiple people in a given data block, the total number of adjacent sensor fires is calculated for that block and multiplied with the normalized adjacency matrix which was calculated from the total collection of the data. This produces the expected adjacency matrix for that data block, which is compared to the actual adjacency matrix for the block. Any entries of the actual adjacency matrix which are statistically significant or "suspiciously large" in relation to the corresponding entry in the expected adjacency matrix are indicative of one of the two scenarios previously discussed which reveal the presence of multiple people in the home. Therefore, data blocks containing suspiciously large entries are denoted as representing the activities of multiple people, and those whose entries can be confidently dismissed as "normal" are denoted as representing the activities of a single person.

While this method presents one way of distinguishing the patterns of adjacent sensor fires between single and multiple person data blocks, it requires a quantitative definition of "very small", "appropriately large", and "suspiciously large" entries in the adjacency matrix, a quantitative description of the confidence of the ascription of single versus multiple persons to a block-of data, and different test parameters for each home denoting which rooms adjoin, which do not, and how much room-to-room traffic is normal.

While the above method provides one possible analysis tool, a preferred test would be a statistical test that avoid the difficulties of quantitative definitions for "very small", "appropriately large", and "suspiciously large" entries in the adjacency matrix. In order to choose the right statistical test for analysis, several observations are made about the chosen data classification. First, analysis of the number of different adjacent sensor fires requires a test which can analyze categorical data, since there is no continuous variable which defines the relationship between different adjacent sensor fires (e.g., note there is no order which can be imposed to define which adjacent sensor fire comes "first", which comes "second", and so on). Second, the distribution of adjacent sensor fires is not expected to be modeled by any particular well-known distribution function; thus, the distribution will not be known until the data is actually examined. Additionally, because of the differences in the layout of peoples' homes and the differences in subjects' lifestyles, the population distribution of adjacent sensor fires should be expected to vary widely across the spectrum of subjects.

An appropriate test to handle the above requirements is the $\chi^2$ test for goodness of fit. This test compares the observed values in each category of a categorical data set to the values expected in each category if that data were drawn perfectly proportionally from a control population distribution. These observed and expected numbers of adjacent sensor fires are calculated as the actual adjacency matrix and the expected adjacency matrix described above. The test then hypothesizes that the tested data is a part of this control group (i.e., the overall complete data set which is again assumed to be representative of a single person's activities in the home). The null hypothesis for this test is therefore that the observed relative frequency in each category is the same as the relative frequency in each category of the control population distribution. For the detection of multiple people in the home, the mathematical descriptions of the hypotheses of this test are:

$H_0$: $\forall i, j \in$ number of sensors; $i \neq j | P(ASF_{i \to j})_{observed} = P(ASF_{i \to j})_{expected}$ $H_a$: $\exists i, j \in$ number of sensors; $i \neq j | P(ASF_{i \to j})_{observed} \neq P(ASF_{i \to j})_{expected}$ with P(x) being the probability that x occurs, and $ASF_{i \to j}$ being the number of adjacent sensor fires from sensor i to sensor j. Put more simply, if the observed data conceivably could have been drawn from the population of the control data, the null hypothesis is true. If chance cannot account for the differences in the observed and control data, the observed data must have been drawn from a different population; the alternative hypothesis is true, and an inference may be made about what characteristics of the two data sets are responsible for the differences. Since the data classification being used was specifically chosen to distinguish between characteristics of the single versus multiple people states, these differences in the data sets are assumed to be due to the data sets belonging to different states. If the null hypothesis is accepted, the data block tested is demarked with the single person state; conversely, if the null hypothesis is rejected, the alternative hypothesis is inferred and the data block is demarked with the multiple person state.

To test these hypotheses for the detection of single versus multiple people in the home, the test statistic, $\chi^2$, is computed as follows. If n samples exist in an observed data set, then let $O_{i \to j}$ the number of $ASF_{i \to j}$ observed, and $E_{i \to j}$=nP $(ASF_{i \to j})_{expected}$, or the number of $ASF_{i \to j}$ to be expected if the proportion of those adjacent sensor fires in the observed data were the same as in the control data population. Then:

$$\chi^2 = \sum_{\substack{\forall i,j \\ i \neq j}} \frac{(O_{i \to j} - E_{i \to j})^2}{E_{i \to j}}.$$

Statisticians and mathematicians have shown that when the observed data set truly is sampled from the population distribution it is being tested against (i.e., the null hypothesis is true), the frequency distribution of this test statistic is modeled by a well-defined mathematical function, regardless of the frequency distribution of the data themselves. Using this function, the $\chi^2$ test statistic allows the computation of the probability that chance variations in the way the observed data was sampled out of its population can account for the differences in the observed and expected values. The probability which serves as the threshold above which the null hypothesis is accepted and below which the null hypothesis is rejected becomes a parameter of the test. As this threshold of probability increases, the chance the calculated probability given by the $\chi^2$ test remains above this threshold decreases, and the null hypothesis is accepted less often. This increases confidence in the assertion that the data blocks attributed with the single person state do genuinely lack any trace of data generated by multiple people (which may confound further analyses) but at the cost of the increased risk of attributing the multiple person state with some blocks incorrectly and dismissing these blocks as bad data. In contrast, decreasing this threshold of probability gives the benefit of the doubt to more data on the verge of being dismissed, but at the cost of decreased confidence that none of the data collected for the single person state has been contaminated by data collected from the multiple person state.

Recalling again the example situations discussed above, where one data block is associated with a single woman in the home and a second data block is associated with both the woman and her son, the $\chi^2$ statistic could be used to determine whether single or multiple persons should be associated with a particular data block. Recall that the adjacent sensor fires in the single person scenario were:

21-23, 23-25, 25-24, 24-25, 25-23, 23-22, 22-23, 23-22.

and the adjacent sensor fires in the multiple person scenario were:

21-23, 23-25, 25-24, 24-23, 23-24, 24-23, 23-24, 24-25, 25-23, 23-22, 22-23, 23-22, 22-23, 23-22, 22-23, 23-22.

If an adjacent sensor fire from one sensor A to a second sensor B is considered to be the same as an adjacent sensor fire from the second sensor to the first sensor A, then the proportion of fires in these two cases are as follows:

Single Person Scenario

| | |
|---|---|
| 21-23: | 1/8 = 12.5% |
| 23-25 (25-23): | 2/8 = 25% |
| 24-25 (25-24): | 2/8 = 25% |
| 22-23 (23-22): | 3/8 = 37.5% |

Multiple Person Scenario

| | |
|---|---|
| 21-23: | 1/16 = 6.25% |
| 23-25 (25-23): | 2/16 = 12.5% |
| 24-25 (25-24): | 2/16 = 15.5% |
| 23-24 (24-23): | 4/16 = 25% |
| 22-23 (23-22): | 7/16 = 43.75% |

Note from FIG. 1 that the 23-24 (24-23) adjacent sensor fire represents a transfer of activity between two non-adjacent rooms (i.e., the hallway 15 must be traversed to move between the kitchen 13 and the bathroom 14). Conversely, the 22-23 (23-22) adjacent sensor fire represents a transfer of activity between two adjacent rooms (the dining room 12 and the kitchen 13).

Assume at this point that a control data distribution (also referred to herein as a control set) has been assembled for the single person present in the home scenario, and the proportion of each adjacent sensor fire looks like this:

Control Data Distribution

| | |
|---|---|
| 21-22 (22-21): | 6% |
| 21-23 (23-21): | 10% |
| 21-24 (24-21): | 0.5% |
| 21-25 (25-21): | 10% |
| 21-26 (26-21): | 0.5% |
| 22-23 (23-22): | 24% |
| 22-24 (24-22): | 0.5% |
| 22-25 (25-22): | 4% |
| 22-26 (26-22): | 0.5% |
| 23-24 (24-23): | 0.5% |
| 23-25 (25-23): | 15% |
| 23-26 (26-23): | 0.5% |
| 24-25 (25-24): | 20% |
| 25-26 (26-25): | 8% |

Note that in each case where the distribution only contains 0.5% of a particular adjacent sensor fires that these occur between non-adjacent rooms. Though missed sensor messages or other transient errors may cause such an ASF to occur infrequently, these proportions approach zero, as expected.

To calculate the $\chi^2$ test statistic, first the expected number of fires in each observed data set must be calculated. This is done by applying the proportion of the control distribution for a particular adjacent sensor fire to the total number of observed fires in the data set. The resulting numbers are the number of sensor fires of that type which would be seen if the distribution of the control and observed data were an exact match. The calculations of expected ASFs for each data block are calculated as follows.

Expected ASFs for Single Person Scenario

| | |
|---|---|
| 21-22 (22-21): | 8(6%) = 0.48 |
| 21-23 (23-21): | 8(10%) = 0.8 |
| 21-24 (24-21): | 8(0.5%) = 0.04 |
| 21-25 (25-21): | 8(10%) = 0.8 |
| 21-26 (26-21): | 8(0.5%) = 0.04 |
| 22-23 (23-22): | 8(24%) = 1.92 |
| 22-24 (24-22): | 8(0.5%) = 0.04 |
| 22-25 (25-22): | 8(4%) = 0.32 |
| 22-26 (26-22): | 8(0.5%) = 0.04 |
| 23-24 (24-23): | 8(0.5%) = 0.04 |
| 23-25 (25-23): | 8(15%) = 1.2 |
| 23-26 (26-23): | 8(0.5%) = 0.04 |
| 24-25 (25-24): | 8(20%) = 1.6 |
| 25-26 (26-25): | 8(8%) = 0.64 |

Expected ASFs for Multiple Person Scenario

| | |
|---|---|
| 21-22 (22-21): | 16(6%) = 0.96 |
| 21-23 (23-21): | 16(10%) = 1.6 |
| 21-24 (24-21): | 16(0.5%) = 0.08 |
| 21-25 (25-21): | 16(10%) = 1.6 |
| 21-26 (26-21): | 16(0.5%) = 0.08 |
| 22-23 (23-22): | 16(24%) = 3.84 |
| 22-24 (24-22): | 16(0.5%) = 0.08 |
| 22-25 (25-22): | 16(4%) = 0.64 |
| 22-26 (26-22): | 16(0.5%) = 0.08 |
| 23-24 (24-23): | 16(0.5%) = 0.08 |
| 23-25 (25-23): | 16(15%) = 2.4 |
| 23-26 (26-23): | 16(0.5%) = 0.08 |
| 24-25 (25-24): | 16(20%) = 3.2 |
| 25-26 (26-25): | 16(8%) = 1.28 |

The test statistic is calculated according to the following equation:

$$\chi^2 = \sum \frac{(O-E)^2}{E},$$

where O is the observed number of adjacent sensor fires found in the data set to be tested, and E is the expected number of adjacent sensor fires of each type based of the proportion of each ASF in the control set (calculated as shown in the tables above).

Below are tables of each type of ASF for both the single and multiple person scenarios with their contribution to the test statistic. Each table is followed by the $\chi^2$ value of the test (which is the sum of all the individual contributions for each test):

$\chi^2$ Contributions to Single Person Scenario Test by ASF Type $$21\text{-}22(22\text{-}21):\ \frac{(0-0.48)^2}{0.48} = 0.48$$

$$21\text{-}23(23\text{-}21):\ \frac{(1-0.8)^2}{0.8} = 0.05$$

$$21\text{-}24(24\text{-}21):\ \frac{(0-0.04)^2}{0.04} = 0.04$$

$$21\text{-}25(25\text{-}21):\ \frac{(0-0.8)^2}{0.8} = 0.8$$

$$21\text{-}26(26\text{-}21):\ \frac{(0-0.04)^2}{0.04} = 0.04$$

$$22\text{-}23(23\text{-}22):\ \frac{(3-1.92)^2}{1.92} = 0.6075$$

$$22\text{-}24(24\text{-}22):\ \frac{(0-0.04)^2}{0.04} = 0.04$$

$$22\text{-}25(25\text{-}22):\ \frac{(0-0.32)^2}{0.32} = 0.32$$

$$22\text{-}26(26\text{-}22):\ \frac{(0-0.04)^2}{0.04} = 0.04$$

$$23\text{-}24(24\text{-}23):\ \frac{(0-0.04)^2}{0.04} = 0.04$$

$$23\text{-}25(25\text{-}23):\ \frac{(2-1.2)^2}{1.2} = 0.5333$$

$$23\text{-}26(26\text{-}23):\ \frac{(0-0.04)^2}{0.04} = 0.04$$

$$24\text{-}25(25\text{-}24):\ \frac{(2-1.6)^2}{1.6} = 0.1$$

$$25\text{-}26(26\text{-}25):\ \frac{(0-0.64)^2}{0.64} = 0.64$$

$$\chi^2 = 3.7708;\ P(\chi^2 = 3.7708,\ df = 13) = 0.993394$$

(where "df" is the degrees of freedom associated with the provided example)

$\chi^2$ Contributions to Multiple Person Scenario Test by ASF Type $$21\text{-}22(22\text{-}21):\ \frac{(0-0.96)^2}{0.96} = 0.96$$

$$21\text{-}23(23\text{-}21):\ \frac{(1-1.6)^2}{1.6} = 0.225$$

$$21\text{-}24(24\text{-}21):\ \frac{(0-0.08)^2}{0.08} = 0.08$$

$$21\text{-}25(25\text{-}21):\ \frac{(0-1.6)^2}{1.6} = 1.6$$

$$21\text{-}26(26\text{-}21):\ \frac{(0-0.08)^2}{0.08} = 0.08$$

$$22\text{-}23(23\text{-}22):\ \frac{(7-3.84)^2}{3.84} = 2.6004$$

$$22\text{-}24(24\text{-}22):\ \frac{(0-0.08)^2}{0.08} = 0.08$$

$$22\text{-}25(25\text{-}22):\ \frac{(0-0.64)^2}{0.64} = 0.64$$

-continued $$22\text{-}26(26\text{-}22):\ \frac{(0-0.08)^2}{0.08}=0.08$$

$$23\text{-}24(24\text{-}23):\ \frac{(4-0.08)^2}{0.08}=192.08$$

$$23\text{-}25(25\text{-}23):\ \frac{(2-2.4)^2}{2.4}=0.0667$$

$$23\text{-}26(26\text{-}23):\ \frac{(0-0.08)^2}{0.08}=0.08$$

$$24\text{-}25(25\text{-}24):\ \frac{(2-3.2)^2}{3.2}=0.45$$

$$25\text{-}26(26\text{-}25):\ \frac{(0-1.28)^2}{1.28}=1.28$$

$$\chi^2=200.3021;\ P(\chi^2=200.3021,\ df=13)=1.1847\times10^{-35}$$

As shown above, the probability that the single person scenario matches the control distribution (chosen to represent periods during which only a single person was present in the home) is 99.3394%. It is therefore implied that the data block and the control data distribution have the same characteristics. Therefore, the test results confirm that the single person scenario corresponds to activity from just a single person.

To the contrary, the probability that the multiple person scenario matches the control distribution is $1.1847\times10^{-33}$%. This is nearly zero. It can therefore be implied that the data block and the control data distribution have differing characteristics and the assumption can be made that the difference arises from the presence of multiple people.

A few observations may be noted from the preceding example. First, note the magnitude of the effect that adjacent sensor fires between non-adjoining rooms have on the outcome of the test. For example, note the 23-24 (24-23) ASFs in the multiple person scenario. The expected value of this ASF is so small (0.08) that its affect on the test statistic is two orders of magnitude larger than any of the other ASFs contribution to the test. Since the presence of any fires from non-adjoining rooms is the strongest indication of the presence of multiple people, this does have the desired affect on the outcome of the test. However, this characteristic of the test might also allow a stray error due to interference in the sensor communication or other transient problem to skew the results of the test. For example, if one single stray ASF between the kitchen sensor and the bathroom sensor occurs in the single person scenario because the fire from the hallway sensor which normally would fire between these two sensors, the results on the test are dramatic. This erroneous ASF causes the probability that the single person data set matches the control set to drop from 99.3394% to 3.4152259%, enough to change the outcome of the test at the standard 5% critical significance level.

Accordingly, in order to allow the test to maintain its accuracy in the event of a few rogue adjacent sensor fires, a modification could be made to the test. The infrequency of these errors (i.e., the rogue adjacent sensor fires) is responsible for the near-zero proportion of the control population made up by each of the individual ASFs which represent activity transfers between non-adjoining rooms. If all of the ASFs of this type (i.e., adjacent sensor fires from non-adjoining rooms) are categorized into one group, the sum of all these rare events can be monitored by the test, instead of individual adjacent sensor fires from non-adjoining rooms, thereby reducing the effect of just one particular ASF from a non-adjoining room on the results. For example, if all of the ASFs from non-adjoining rooms in the above example were combined into one group (i.e., the "error group" for the single person scenario), the control distribution percentage for this error group would be 3% (i.e., each of the six 0.5% percentages from ASFs related to non-adjoining rooms added together). Assuming that there is one additional ASF in the example to account for the rogue ASF, there are 9 total ASFs in the example. The expected ASFs for the error group would be 0.27 (i.e., 9×(0.03)). The contribution of the rogue sensor fire to the $\chi^2$ test statistic for the single person scenario would then be 1.9737 (i.e., $(1-0.27)^2\div(0.27)$), the total $\chi^2$ test statistic would be 5.1667. Based on the results of these tests, the single person scenario with the erroneous ASF still has a 73.96% chance to match the single person control distribution (i.e., $P(\chi^2=5.1667,\ df=8)=0.739619512$).

If a similar calculation to that of the above paragraph is made for a rogue ASF in the scenario where multiple people are actually present in the home, the result is only a 0.0047294% chance that the multiple person scenario matches the single person control distribution. This easily allows an inference to be drawn that this data set has different characteristics than the single person control set. It is therefore inferred that the characteristic that differs in this data set is the number of people in the home and this data set is ascribed this block with the multiple person state.

Note that the alternative embodiment of the test described in the above paragraphs for an "error group" is able to still distinguish the single person scenario as a match to the control set where the first described embodiment of the test could not. Furthermore, the alternative embodiment of the test where an "error group" is formed does not lose its ability to distinguish the multiple person scenario as different than the control set.

However, this concept of utilizing different categorizations of data could also be used to improve the performance of the test in the case that achieving this error tolerance at the cost of sensitivity is undesirable. For instance, if the data communication between the sensors and the central receiver takes place via an error-detecting protocol, then blocks which contain errors in the sensor fire data can be separated from those blocks wherein the sensor fires were recorded completely and accurately. In the case where the error-detecting mechanism determines that a given home state block contains only correct data, the categorization described above for tolerating erroneous data is unnecessary. Since the analysis is confident that any adjacent sensor fires between non-contiguous rooms cannot be associated with errors in the data, the hypersensitivity of the test to these fires allows a multiple person state to be discovered even with very few indicators in the data.

Instead, an alternative data categorization can be used to desensitize the test to abnormally high activity in rooms of a home where activity is normally sparse. Note that a low relative frequency of a particular adjacent sensor fire in the control data distribution is normally an indication that the two sensors which make up that ASF belong in non-contiguous rooms. However, the possibility exists that a subject may have a particular room in his or her home which is rarely visited, such as a guest bedroom. If activity in this room is infrequent enough, the analysis may incorrectly determine based on the low relative frequency of the adjacent sensor fires involving that room that several rooms which may be contiguous to the infrequently visited room are not. Activity that later does occur in the infrequently visited room in an observed data block may then be ascribed to the multiple people state because of its deviation from the normal activity in the home.

To avoid this circumstance, the relative frequency of each adjacent sensor fire with respect to the entire adjacency matrix is compared with the relative frequency with respect to only those ASFs involving the room in question. If the relative frequency of a particular ASF with respect to the entire matrix is high enough (say over 5%, for instance), it corresponds with significant activity between two contiguous rooms. If the relative frequency for that ASF is instead too low with respect to the entire matrix and the vector of possible ASFs involving the room in question, it corresponds with inactivity due to the non-contiguous arrangement of the two rooms. However, if the relative frequency of the ASF with respect to the entire matrix is low while its frequency relative to the vector of ASFs only involving that room is high, then little activity occurred between the two rooms, but what activity that did occur made up a significant portion of the overall activity in that room. This case likely corresponds to sparse activity between two contiguous rooms, one of which is only rarely visited. Since a single person's activities can easily generate these types of ASFs, the desired influence on the results of the test should be smaller than those which are certain to correspond to non-contiguous rooms. Grouping each ASF from rarely visited rooms into one category for the statistical test will reduce each individual ASF from that category's influence on the test in a similar way to grouping all the rare ASFs reduced the influence of errors on the test in the scenario described previously.

A second observation to be noted from the above examples relates to the way the results of the test are interpreted. When the test statistic indicates a probability that the tested data block matches the control data distribution, this represents the chances that the data for both set of data were drawn from the same population. If this is the case, then both sets of data have the same characteristics, which allow the inference to be drawn that the observed data block has the single person state if the control data distribution has the single person state. However, the converse is not necessarily true. Specifically, if the probability indicates that the observed data block was not drawn from the same population as the control data distribution for the single person state, the only inference that may be drawn from that information alone is that some characteristic of the observed data block differs. The characteristic that differs need not necessarily be that the observed data block has the multiple person state. Since domain knowledge indicates to us that the multiple person characteristic is the one which will most often differ, number of people in the home thus far has been heuristically assumed to be the characteristic which differed between the control data and observed data blocks. Several further tests are possible to improve on this assumption. One such test involves calculating the sole contribution of non-contiguous ASFs to the test statistic. Since non-contiguous ASFs are part of the group of fires that can only occur in the case of multiple people, the statistical test can be performed using the non-contiguous ASFs alone, thereby providing a probability that the data set matches the control set based only on a characteristic normally occurring in the multiple person state. If a number of such non-contiguous ASFs are present, the $\chi^2$ statistic will be high and the probability will be low that the data block matches the control data distribution set. If this is the case, not only does the observed data differ from the control data set, but because the group of ASFs unique to the multiple person state are by themselves enough to determine that the observed data differs from the control data set, the single v. multiple person state is, in fact, determined to be the characteristic responsible for this difference.

Note that that the above test will only confirm a multiple person block that is due to fires from non-adjoining rooms. For the case where multiple people concurrently occupy adjoining rooms, another test will have to be used to make this confirmation. To account for the case where multiple people occupy adjoining rooms, a frequency analysis test of how fast the ASFs occur due to the transitions between rooms may be able to reveal when these fires occurred due to multiple people and when the fires occurred because of legitimate single person activity back and forth between rooms (when the subject is sick and is moving around frequently between the bedroom and bathroom, for example).

A related observation is that the original statistical test may be reversed to test whether or not observed data sets match the characteristics of a multiple person control set similar to the way tests against the single person control set are performed. Once the initial single person control set is in place, those data sets that are determined not to match the single person data profile can be included in a separate control set of their own for the reversed test (i.e., a multiple person control set). Once this new multiple person control set is assembled, both tests can be run against a particular data set. If the two tests agree that a block has the single or multiple person state, the block will be ascribed with that characteristic, and if the tests disagree, the block is likely to belong to the single person state on a day where the subject's behavior just significantly deviated from the norm for some reason (a potential alert condition itself).

Although the passive home monitoring system and method for distinguishing single versus multiple persons has been described in considerable detail with reference to certain preferred versions thereof, other versions are possible. For example, the description of the data segmentation phase of the data analysis assumed that the door opening and closing events occurred concurrently in time, and both could be collapsed into a single event demarking a discrete break between one block of data and the next. However, if a subject opens his or her door and leaves it open, that entire length of time represents a period during which the single versus multiple person state of the home could change without a door open/close event. Unfortunately, collapsing the door open/close events in this situation precludes retaining any of the data collected during that period of time. An effort could be made to alleviate the data loss realized in homes whose residents leave a door open for prolonged periods of time. Instead of dismissing these data blocks completely, these data blocks could be divided into smaller blocks based on some period of time. Each of these blocks could then be tested using the methods described. If the tests deem any of these blocks exhibit the characteristics of the single person state, those blocks may be retained for further analysis. This division of blocks may be performed recursively on the remaining blocks in order to salvage as much data as possible. In another exemplary alternative embodiment of the invention, the control data distribution set could be compiled from all data collected, if it is assumed that the subject will normally be alone in the house. However, the preferred embodiment of the invention anticipates a much more powerful test because data suspected of belonging to the multiple person state is not included in the control group. In particular, the preferred embodiment assumes that the subject is alone when he or she is sleeping. However, other indicators could be used to suggest data that may be used to build the control data distribution set for the single person state. Of course, other such revisions to the invention are possible, and the above described alternative embodiments are only a few of the countless possibilities of alternative embodiments of the invention. Therefore, the spirit and scope of the appended claims should not be limited to the description of the preferred versions contained herein.

What is claimed is:

1. A method of monitoring a residence comprising:

a. providing a plurality of sensors in the residence;

b. collecting data from the plurality of sensors, including adjacent sensor fire data; and c. distinguishing whether a single person is present in the residence or multiple persons are present in the residence by analyzing the adjacent sensor fire data, wherein analysis of the adjacent sensor fire data includes comparing the adjacent sensor fire data to a control data distribution.

2. The method of claim 1 further comprising the step of analyzing the data to determine if an alert condition exists if a single person is present in the residence.

3. The method of claim 1 wherein analysis of the adjacent sensor fire data includes determining if a statistically significant number of non-contiguous adjacent sensor fires exist.

4. A method of monitoring a residence comprising:

a. providing a plurality of sensors in the residence;

b. collecting data from the plurality of sensors, including adjacent sensor fire data; and c. distinguishing whether a single person is present in the residence or multiple persons are present in the residence by analyzing the adjacent sensor fire data, wherein analysis of the adjacent sensor fire data includes determining whether a statistically significant number of adjacent sensor fires exist over a period of time.

5. A method of monitoring a residence comprising:

a. collecting data from the residence;

b. distinguishing whether a single person is present in the residence or multiple persons are present in the residence, wherein determining whether a single person or multiple persons are present in the residence includes performing a statistical calculation to determine the probability that a single person is present in the residence; and c. if a single person is distinguished as present in the residence, analyzing the data to determine if an alert condition exists.

6. The method of claim 5 wherein the data collected from the residence includes adjacent sensor fire data.

7. The method of claim 6 wherein the adjacent sensor fire data is analyzed in distinguishing whether a single person is present in the residence or multiple persons are present in the residence.

8. The method of claim 7 wherein the adjacent sensor fire data is analyzed by comparing the adjacent sensor fire data to a control data distribution.

9. The method of claim 7 wherein the adjacent sensor fire data is analyzed by determining if a statistically significant number of non-contiguous adjacent sensor fires exist.

10. The method of claim 7 wherein the adjacent sensor fire data is analyzed to determine if a statistically significant number of adjacent sensor fires exist over a period of time.

11. The method of claim 5 wherein the step of analyzing the data to determine if an alert condition exists comprises weighting the data based upon the probability that a single person is present in the residence.

12. A method of passively monitoring the activities of an individual in a residence having a plurality of areas, the method comprising:

a. providing a plurality of sensors;

b. collecting sensor fire data from the plurality of sensors and separating the sensor fire data into a plurality of data blocks;

c. determining whether one of the plurality of data blocks is associated with the presence of a single person in the residence or multiple persons in the residence; and d. if the one of the plurality of data blocks is associated with the presence of a single person in the residence, analyzing the sensor fire data included in the one of the plurality of data blocks.

13. The method of claim 12 wherein the sensor fire data is separated into the plurality of data blocks based upon the occurrence of a door opening event.

14. The method of claim 12 wherein the step of analyzing the sensor fire data includes determining if an alert condition exists.

15. The method of claim 14 wherein the step of determining whether one of the plurality of data blocks is associated with the presence of a single person in the residence or multiple persons in the residence comprises performing a statistical calculation to determine the probability that the one of the plurality of data blocks is associated with the presence of a single person in the residence.

16. The method of claim 15 wherein the step of analyzing the sensor fire data comprises weighting the sensor fire data based upon the probability that a single person is present in the residence.

17. The method of claim 12 wherein the step of determining whether one of the plurality of data blocks is associated with the presence of a single person in the residence or multiple persons in the residence includes analyzing adjacent sensor fires included in the sensor fire data.

18. A system for monitoring a life form in a residence having a plurality of areas, the system comprising:

a. a plurality of sensors, each of the plurality of sensors operable to detect the life form in one of the plurality of areas;

b. a receiver in communication with the plurality of sensors, the receiver operable to collect sensor fire data from each of the plurality of sensors, including adjacent sensor fire data;

c. a processor in communication with the receiver, the processor operable to analyze the adjacent sensor fire data collected by the receiver and distinguish whether a single person is present in the residence or multiple persons are present in the residence, wherein analysis of the adjacent sensor fire data includes comparing the adjacent sensor fire data to a control data distribution.

19. A method of distinguishing whether a single person or multiple persons are present in a residence having a plurality of areas, the method comprising the steps of:

a. providing a plurality of sensors, each of the plurality of sensors associated with one of the plurality of areas and each of the plurality of sensors operable to detect the existence of a person in the one of the plurality of areas;

b. collecting sensor fire data from the plurality of sensors to build a sensor fire data set containing a plurality of adjacent sensor fires;

c. analyzing the adjacent sensor fires to distinguish whether a single or multiple persons are present in the residence, wherein analysis of the adjacent sensor fires includes determining whether a statistically significant number of adjacent sensor fires exist over a period of time.

20. The method of claim 19 wherein the plurality of areas include at least one non-contiguous area.

21. The method of claim 20 wherein the step of analyzing the adjacent sensor fires to distinguish whether a single or multiple persons are present in the residence includes determining whether any of the adjacent sensor fires are associated with the at least one non-contiguous area.

22. A method for determining whether multiple persons are present in a residence having a first area that is contiguous with a second area and a third area that is not contiguous with the first area, the method comprising:

a. providing a plurality of sensors, the plurality of sensors including a first sensor operable to fire when a person is detected in the first area, a second sensor operable to fire when a person is detected in the second area, and a third sensor operable to fire when a person is detected in the third area;

b. collecting sensor fire data from the plurality of sensors to build a sensor fire data set containing a plurality of adjacent sensor fires; c. determining that multiple persons are present in the residence when a statistically significant number of the plurality of adjacent sensor fires include both the first sensor and the third sensor.

23. A method of determining whether a single life form or multiple life forms are present in a residence having a plurality of areas, wherein some of the plurality of areas are contiguous and other of the plurality of areas are not contiguous, each of the plurality of areas associated with a sensor that is operable to fire when life form activity is detected in the area, the method comprising:

a. monitoring adjacent sensor fires; and b. using adjacent sensor fires from activity occurring in non-contiguous areas as indicative of the presence of multiple life forms in the residence.

24. The method of claim 23 further comprising the step of using a statistically significant number of adjacent sensor fires over a period of time as indicative of the presence of multiple life forms in the residence.

25. A method of determining whether a single or multiple life forms are present in a residence having a plurality of areas, each of the plurality of areas associated with a sensor that is operable to fire when life form activity is detected in the area, the method comprising:

a. collecting sensor fire data from the plurality of sensors to build a sensor fire data set containing a plurality of adjacent sensor fires;

b. forming a first control data distribution set for adjacent sensor fires that is associated with a single life form being present in the residence;

c. performing a statistical test to compare the sensor fire data set with the control data distribution set, the statistical test yielding a first result; and d. using the first result as indicative that a single life form is present in the home if the first result meets a first predetermined threshold.

26. The method of claim 25 wherein the statistical test is a goodness-of-fit test.

27. The method of claim 26 wherein the goodness-of-fit test is the chi-square test.

28. The method of claim 25 further comprising a. forming a second control data distribution set for adjacent sensor fires that is associated with a plurality of life forms being present in the residence;

b. performing a second statistical test to compare the sensor fire data set with the second control data distribution set, the second statistical test yielding a second result; and c. using the second test result as indicative that multiple life forms are present in the home if the first statistical test yields a result that does not meet the first predetermined threshold but the second statistical test does meet a second predetermined threshold.

29. A method of passively monitoring the activities of an individual in a residence, the method comprising:

a. providing a plurality of sensors;

b. collecting sensor fire data from the plurality of sensors, the sensor fire data including a plurality of adjacent sensor fires;

c. determining the probability that a single person is present in the residence based on the plurality of adjacent sensor fires;

d. if a single person is determined to be present in the residence, weighting the sensor fire data based on the probability that a single person is present in the residence; and e. analyzing the weighted sensor fire data to determine if an alert condition exists.

30. A system for monitoring a life form in a residence having a plurality of areas, the system comprising:

a. a plurality of sensors, each of the plurality of sensors operable to detect the life form in one of the plurality of areas;

b. a receiver in communication with the plurality of sensors, the receiver operable to collect sensor fire data from each of the plurality of sensors, including adjacent sensor fire data;

c. a processor in communication with the receiver, the processor operable to analyze the adjacent sensor fire data collected by the receiver and distinguish whether a single person is present in the residence or multiple persons are present in the residence, wherein analysis of the adjacent sensor fire data includes determining whether a statistically significant number of adjacent sensor fires exist over a period of time.

* * * * *